US010307314B2

(12) United States Patent
Griffith et al.

(10) Patent No.: US 10,307,314 B2
(45) Date of Patent: Jun. 4, 2019

(54) MODULAR WHEELCHAIR SYSTEM

(71) Applicants: Erich C. Griffith, Warsaw, IN (US); Jason L. Ward, Warsaw, IN (US)

(72) Inventors: Erich C. Griffith, Warsaw, IN (US); Jason L. Ward, Warsaw, IN (US)

( * ) Notice: Subject to any disclaimer, the term of this patent is extended or adjusted under 35 U.S.C. 154(b) by 0 days.

(21) Appl. No.: 15/700,818

(22) Filed: Sep. 11, 2017

(65) Prior Publication Data

US 2017/0367910 A1 Dec. 28, 2017

Related U.S. Application Data

(63) Continuation-in-part of application No. 15/287,290, filed on Oct. 6, 2016.

(60) Provisional application No. 62/237,658, filed on Oct. 6, 2015.

(51) Int. Cl.

| | |
|---|---|
| ***A61G 5/00*** | (2006.01) |
| ***A61G 5/10*** | (2006.01) |
| ***A61G 5/08*** | (2006.01) |
| ***A61G 5/12*** | (2006.01) |
| ***A61G 1/06*** | (2006.01) |

(52) U.S. Cl.

CPC ..... *A61G 5/006* (2013.01); *A61G 1/06* (2013.01); *A61G 5/0866* (2016.11); *A61G 5/0875* (2016.11); *A61G 5/0883* (2016.11); *A61G 5/1067* (2013.01); *A61G 5/128* (2016.11); *A61G 5/125* (2016.11); *A61G 5/127* (2016.11); *A61G 2203/80* (2013.01)

(58) Field of Classification Search

CPC ..... A61G 5/00

See application file for complete search history.

(56) References Cited

U.S. PATENT DOCUMENTS

| | | | | |
|---|---|---|---|---|
| 4,362,311 | A * | 12/1982 | Bergman | A61G 5/00 280/250.1 |
| 6,776,430 | B2 * | 8/2004 | White | A61G 5/045 180/907 |
| 7,185,951 | B2 | 3/2007 | Johnson et al. | |
| 8,596,719 | B2 * | 12/2013 | Engman | A61G 5/1067 297/343 |
| 2009/0121531 | A1 * | 5/2009 | Appelqvist | B60N 2/10 297/300.4 |
| 2017/0028883 | A1 * | 2/2017 | Kasuga | B60N 2/68 |

* cited by examiner

*Primary Examiner* — James A Shriver, II
*Assistant Examiner* — James J Triggs
(74) *Attorney, Agent, or Firm* — Taylor IP, P.C.

(57) ABSTRACT

A convertible transport system including a seat portion, a back support portion, and a pivoting mechanism coupled to the seat portion and to the back support portion. The pivoting mechanism is configured to adjust and lock the back support portion relative to the seat portion, the pivoting mechanism having three operative states: a free pivoting state allowing the back support portion to pivot relative to the seat portion about an axis; a ratcheting state allowing the back support portion to only pivot toward the seat portion about the axis; and a locking state in which the pivoting mechanism is locked to thereby prevent a pivoting movement of the back support portion relative to the seat portion.

18 Claims, 8 Drawing Sheets

MODULAR WHEELCHAIR SYSTEM

CROSS REFERENCE TO RELATED APPLICATIONS

This is a Continuation-in-part application based upon U.S. non-provisional patent application Ser. No. 15/287,290, entitled "MODULAR WHEELCHAIR SYSTEM", filed Oct. 6, 2016, which is incorporated herein by reference. patent application Ser. No. 15/287,290, is a non-provisional application based upon U.S. provisional patent application Ser. No. 62/237,658, entitled "MODULAR WHEELCHAIR SYSTEM", filed Oct. 6, 2015.

BACKGROUND OF THE INVENTION

1. Field of the Invention

The present invention relates to wheelchairs, and, more particularly, to wheelchairs that are adaptable to other healthcare uses.

2. Description of the Related Art

Wheelchairs typically incorporate a seat, foot rests and four wheels. There are usually two caster wheels at the front and two large wheels at the back of the chair. The two larger wheels in the back usually have hand rims that have a diameter normally only slightly smaller than the wheels they are attached to, and are present to allow the occupant to grasp and propel the chair. Most wheelchairs also have two handles at the top of the back to allow for manual propulsion of the chair by another person.

Other wheelchairs are variations on this basic design, but they can be customized to meet the user's needs. Seat dimensions, height of the chair, seat angle, footrests, leg rests, front caster outriggers and adjustable backrests are all items that can be customized. Additionally, propulsion and control systems can be added to allow mobility to those that have limited use of their arms.

Wheelchairs come in two major designs—folding or rigid. The rigid chairs have permanently welded joints and fewer moving parts than folding chairs. This reduces the energy required to propel the chair by eliminating many flex points whereat the chair would flex as it moves. Welding the connections, rather than making them joints also reduces the overall weight of the chair. Even though they may be considered to be a rigid chair they typically feature instant-release rear wheels and backrests that fold down flat, allowing the user to dismantle the chair quickly for storage and transport in a car.

Many rigid models are made with lightweight materials such as aircraft aluminum and titanium. Rigid chair design can also have polymer shock absorbers, such as Frog Legs, which cushion the bumps over which the chair rolls. The shock absorbers may be added to the front wheels or to the rear wheels, or both. Rigid chairs also have the option for their rear wheels to have a camber. Wheels can have a camber, or tilt, which angles the tops of the wheels in toward the chair. This allows for better propulsion by the user which is desired by long-term users. Sport wheelchairs have large camber angles to improve stability.

Various optional accessories are available, such as anti-tip bars or wheels, safety belts, adjustable backrests, tilt and/or recline features, extra support for limbs or neck, mounts or carrying devices for crutches, walkers or oxygen tanks, drink holders, and clothing protectors.

Transport wheelchairs are usually light, folding chairs that are designed to be pushed by a caregiver to provide mobility for patients outside the home or common medical settings.

Variations in wheelchair construct include tilt wheelchairs that have seating surfaces which can be tilted to various angles. A standing wheelchair is one that supports the user in a nearly standing position. They can be used as both a wheelchair and a standing frame, allowing the user to sit or stand in the wheelchair as they wish. They often go from sitting to standing with a hydraulic pump or electric-powered assist. Bariatric wheelchairs are designed to support larger weights, since most standard chairs are designed to support no more than 250 lb. Pediatric wheelchairs are another available subset of wheelchairs. Hemi wheelchairs have lower seats which are designed for easy foot propulsion.

There are various mechanisms and caregiver techniques that are used to transition a person to/from a wheelchair. Each puts the person at the risk for injury.

What is needed in the art is a wheelchair system that reduces the risk of injury as the wheelchair is adapted for other uses.

SUMMARY OF THE INVENTION

The present invention provides a wheelchair system that converts to other transport configurations.

The invention in one form is directed to a convertible transport system including a seat portion, a back support portion, and a pivoting mechanism coupled to the seat portion and to the back support portion. The pivoting mechanism is configured to adjust and lock the back support portion relative to the seat portion, the pivoting mechanism having three operative states: a free pivoting state allowing the back support portion to pivot relative to the seat portion about an axis; a ratcheting state allowing the back support portion to only pivot toward the seat portion about the axis; and a locking state in which the pivoting mechanism is locked to thereby prevent a pivoting movement of the back support portion relative to the seat portion.

The invention in another form is directed to a convertible wheelchair system including a seat portion, a wheeled portion decouplable from the seat portion, a back support portion, and a pivoting mechanism coupled to the seat portion and to the back support portion. The pivoting mechanism is configured to adjust and lock the back support portion relative to the seat portion, the pivoting mechanism having three operative states: a free pivoting state allowing the back support portion to pivot relative to the seat portion about an axis; a ratcheting state allowing the back support portion to only pivot toward the seat portion about the axis; and a locking state in which the pivoting mechanism is locked to thereby prevent a pivoting movement of the back support portion relative to the seat portion.

An advantage of the present invention is that a patient can be repositioned from a sitting position in a chair to a reclining position in a bed, without being removed from the frame and cushions of the chair.

Another advantage is that a patient can be prepositioned on the mechanism in a bed and the mechanism can be lifted and reconfigured to the sitting position of a chair.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1A:
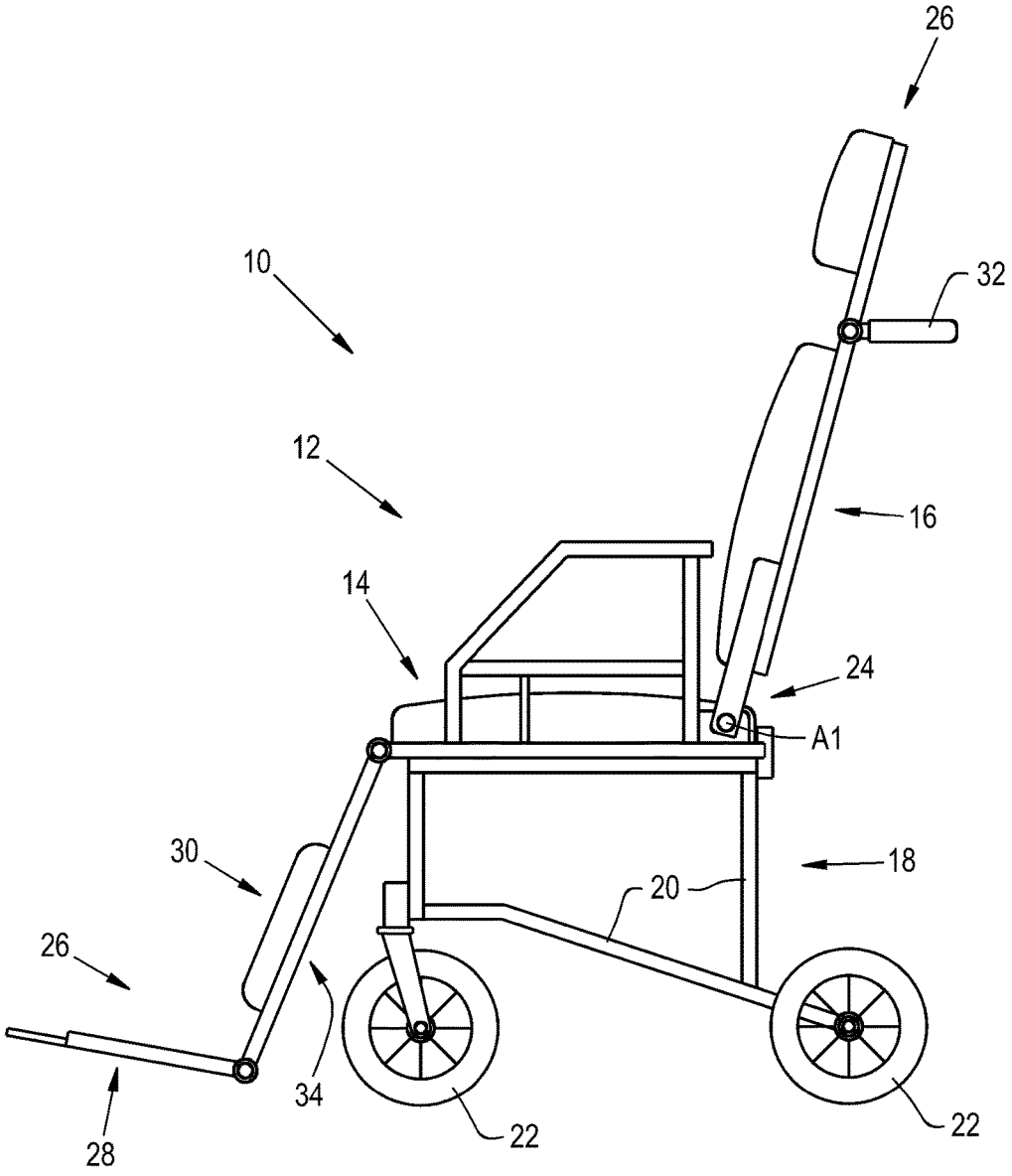
FIG. 1A illustrates an embodiment of a wheelchair of the present invention.
Figure 1B:
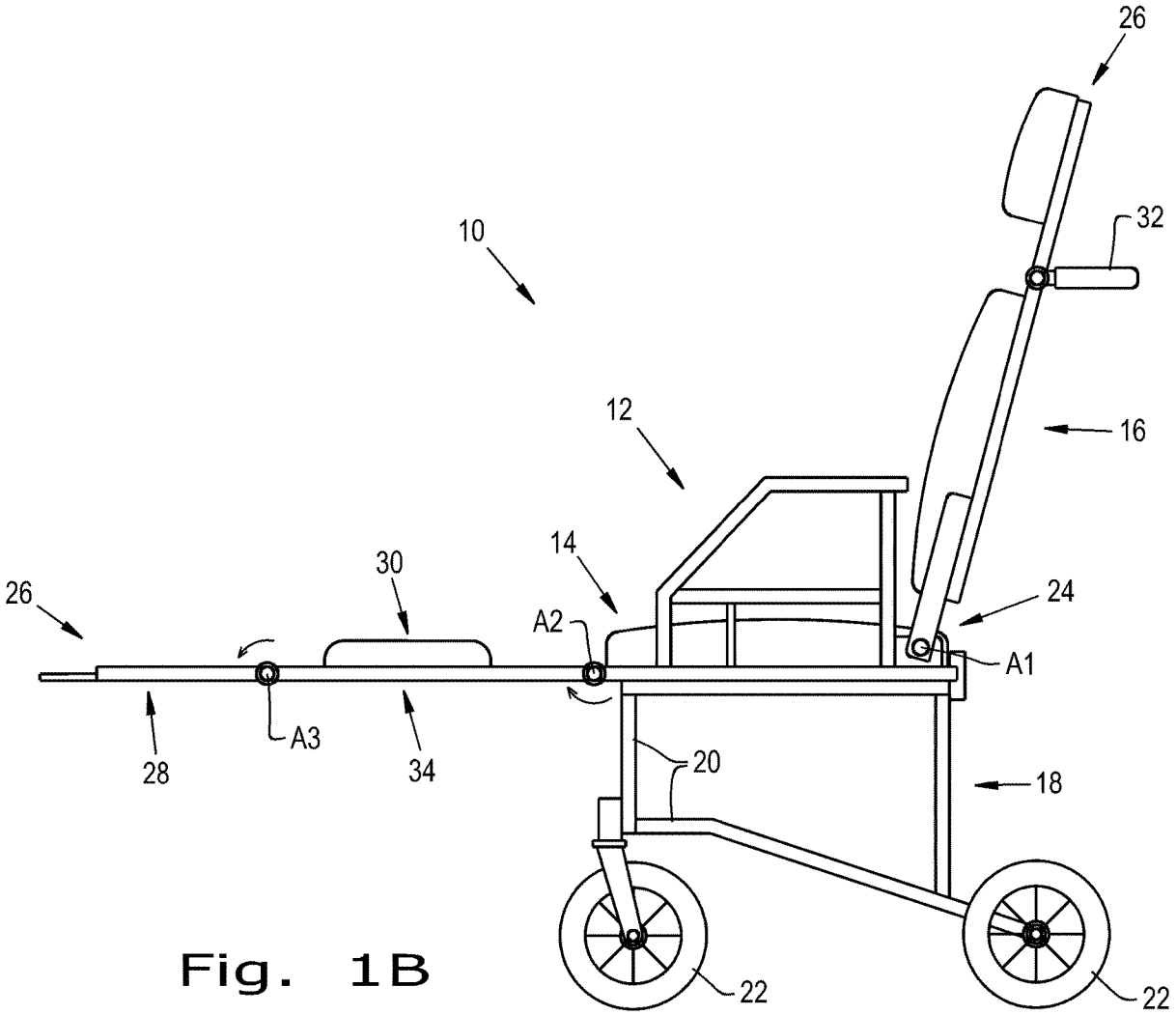
FIG. 1B illustrates the wheelchair of FIG. 1A as the wheelchair takes one step in a transition for the transport of a patient arriving at a horizontal transport position.

Referring now to the drawings, and more particularly to FIGS. 1A-1E and 2-7, there is shown a Convertible transport system 10 having a wheelchair system 12 that includes a seat portion 14, a back support portion 16, and a wheeled portion 18. Wheeled portion 18 has a chassis 20 with wheels 22 coupled thereto.

A pivoting mechanism 24 is coupled to seat portion 14 and to back support portion 16. Pivoting mechanism 24 is configured to adjust and lock back support portion 16 relative to seat portion 14.

Figure 7:
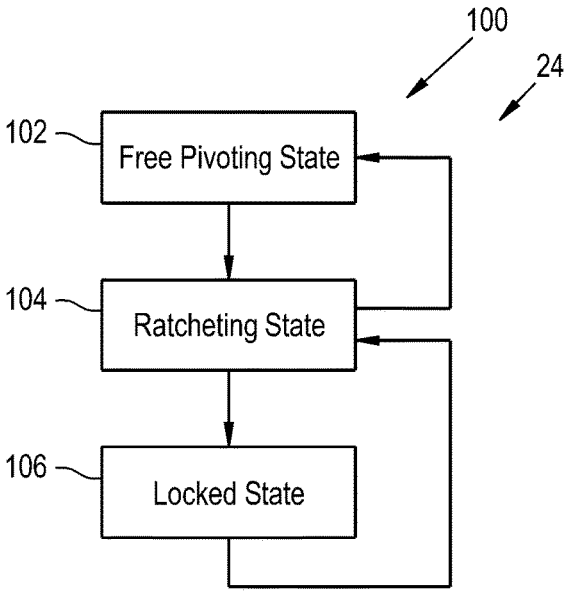
FIG. 7 illustrates three operating states of the pivoting mechanism of FIGS. 2-6.

The pivoting mechanism 24 has three operative states 100, as illustrated in FIG. 7, those being a free pivoting state 102, a ratcheting state 104, and a cocking state 106. The free pivoting state 102 allows back support portion 16 to pivot relative to seat portion 14 about an axis A1 in either rotational direction, allowing back support portion 16 to pivot to any position, but preferably from a seated scenario to a horizontal laying flat scenario for a patient on seat portion 14. The ratcheting state 104 allows the back support portion 16 to only fold or pivot toward the seat portion 14 about axis A1. The locking state 106 holds pivoting mechanism 24 in a locked position to thereby prevent a pivoting movement of the back support portion 16 relative to the seat portion 14.

Wheeled portion 18 is couplable and decouplable to seat portion. 14. A patient portion 26 of system 10 includes seat portion 14, back support portion 16, pivoting mechanism 24, a foot support portion 28, a connecting member 30, and handles 32. Patient portion 26 is detachable from wheeled portion 18 and can be lifted to a support 50, which may be in the form of a cart 50 for the transporting of a patient, after patient portion 26 is coupled to support 50. Support 50 has a framework 52 that has coupling devices to secure patient portion 26 thereto. Support 50 also has wheels 54 coupled to framework 52 for the ease of transporting patient portion 26. Support 50 is couplable to seat portion 14, but is not couplable to wheeled portion 18.

Connecting member 30 is coupled to foot support portion 28 and to seat portion 14. Connecting member 30 is pivotally coupled to foot support portion 28, with connecting member 30 also being pivotally coupled to seat portion 14. Connecting member 30 includes a mechanism 34 that couples an angular movement of foot portion 28 relative to connecting member 30 to an angular movement of connecting member 30 relative to seat portion 14. Mechanism 34 of connecting member 30 causes a clockwise movement of connecting member 30 relative to seat portion 14 (about an axis A2) to result in a counter-clockwise movement of foot support portion 28 (about an axis A3).

The hinging mechanisms for axis A1, A2 and A3 can be a double Sprag roller clutch that can use a dampening biasing mechanism, for example in the form of a coil spring to provide a pre-loaded/dampening function. This alternative embodiment can have locking positions, for example, between and at 90 and 180 degrees of angular movement. The locking is bidirectional to provide a rigid transport system when the mechanism is locked. Each of the hinging mechanisms can have more than one loading spring to assist in the angular movement. It is also contemplated to have an active system driven pneumatically, hydraulically, or electrically to effect the movements described herein. It is also contemplated to have more than one pivoting mechanism per axis using a clutching and/or a ratcheting system to control the movement thereof.

At least one of handles 32 serves as a control device 32 that is controllingly coupled to pivoting mechanism 24, with control device 32 being movable by an operator to select the operative state of pivoting mechanism 24. Handles 32 are connected to back support portion 16, and the coupling to pivoting mechanism 24 can be in the form of cables, pneumatic, hydraulic, electrical or other controllable elements. Control device 32 is connected at an end of the back support portion 16 that is opposite to the end to which the pivoting mechanism 24 is connected. Handle 32 can be twisted so that the operative state 102, 104 or 106 of the pivoting mechanism 24 is selected. When pivoting mechanism 24 has transitioned to a locking state 106 the ratcheting state 104 remains engaged, but is immobilized.

Figure 1C:
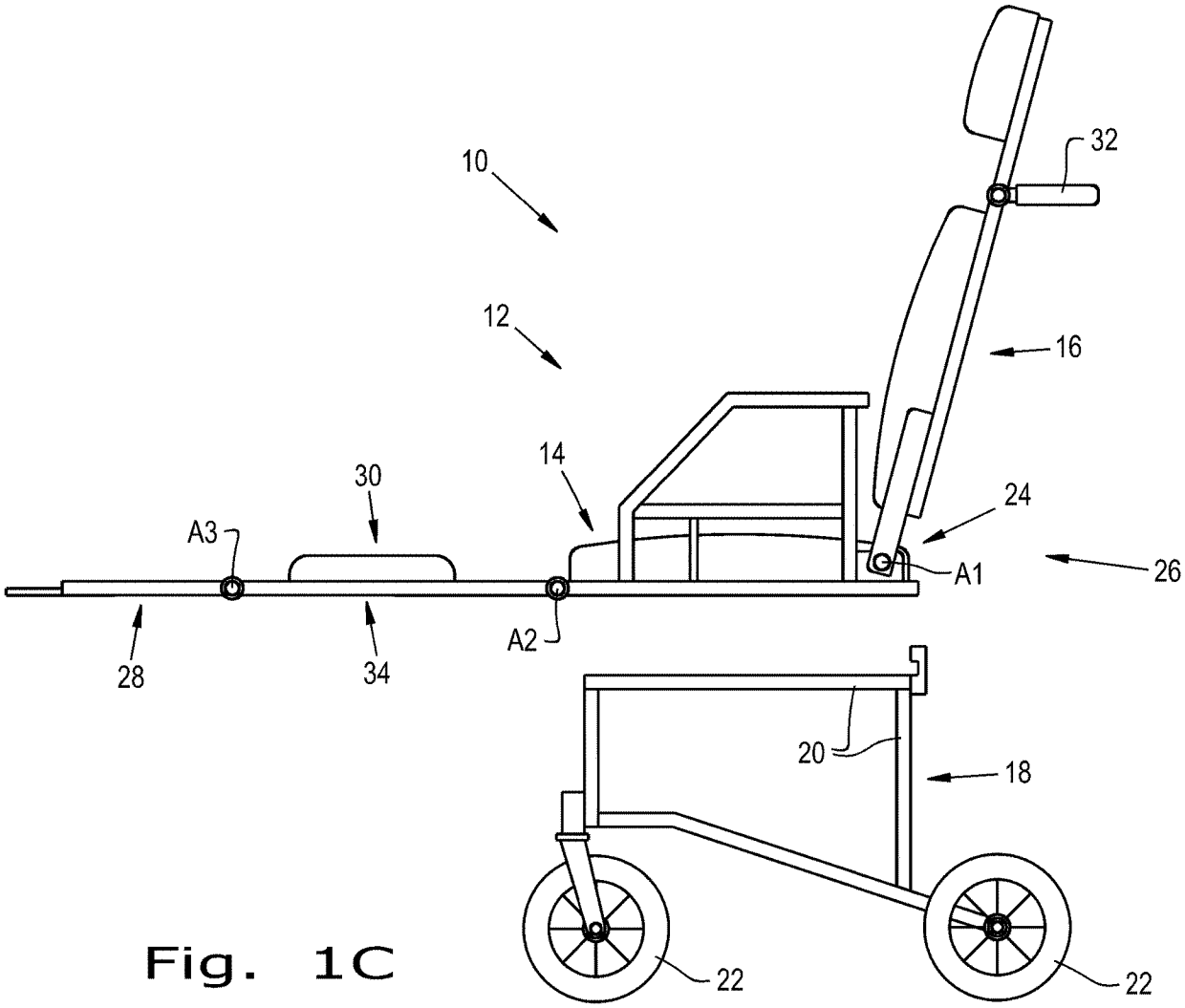
FIG. 1C illustrates the wheelchair of FIG. 1A as the wheelchair takes another step in the transition to a horizontal transport position.
Figure 1D:
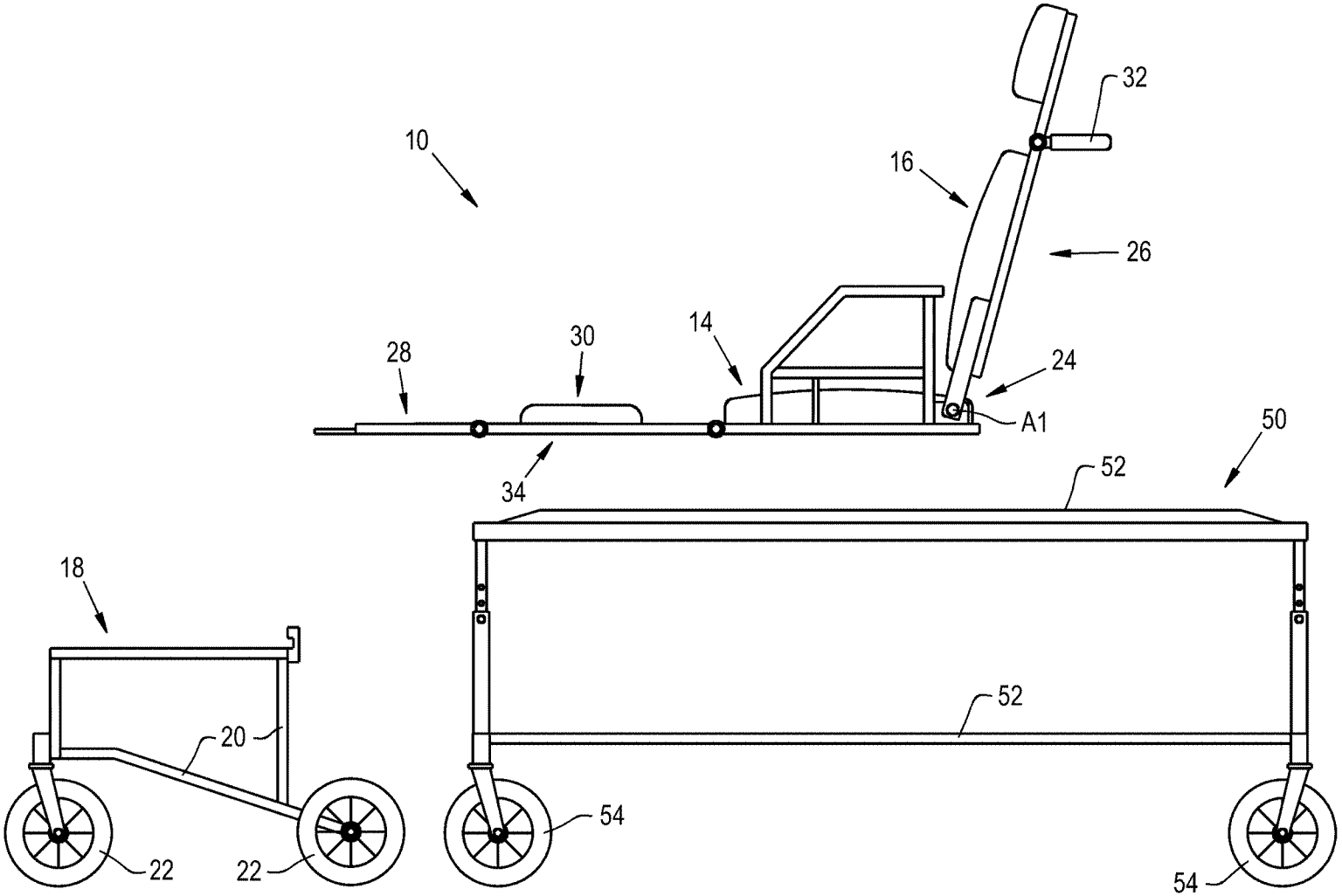
FIG. 1D illustrates the wheelchair of FIG. 1A as the wheelchair takes yet another step in the transition to a horizontal transport position.

Looking now at FIGS. 1A-1E in sequence, the interaction of wheeled portion 18 and support 50 relative to patient portion 26 can be seen. As patient portion 26 transitions to the position shown in FIG. 1B connecting portion 30 has rotated in a clockwise direction about axis A2, and foot support portion 28 has pivoted counterclockwise about axis A3. In FIG. 1C patient portion 26 is detached from wheeled portion 18 by way of a lift mechanism, not shown, but known and used in medical and healthcare environments. In FIG. 1D patient portion 26 is moved atop support 50 and is secured thereto in FIG. 1E. Also in FIG. 1E, handle 32 has been twisted to place pivoting mechanism in state 102 from state 106 by way of state 104 so that back support portion 16 can be lowered to framework 52. Note handle 32 also pivots for the ease of operator use. It is also contemplated that the pivoting of handle 32 may also control the angle of movement of back support portion 16 relative to seat portion 14 about axis A1. When back support portion 16 is resting upon framework 52, pivoting mechanism can be placed in state 106. It can be noted that the pivoting actions described can take place in differing amounts and differing sequences.

Figure 1E:
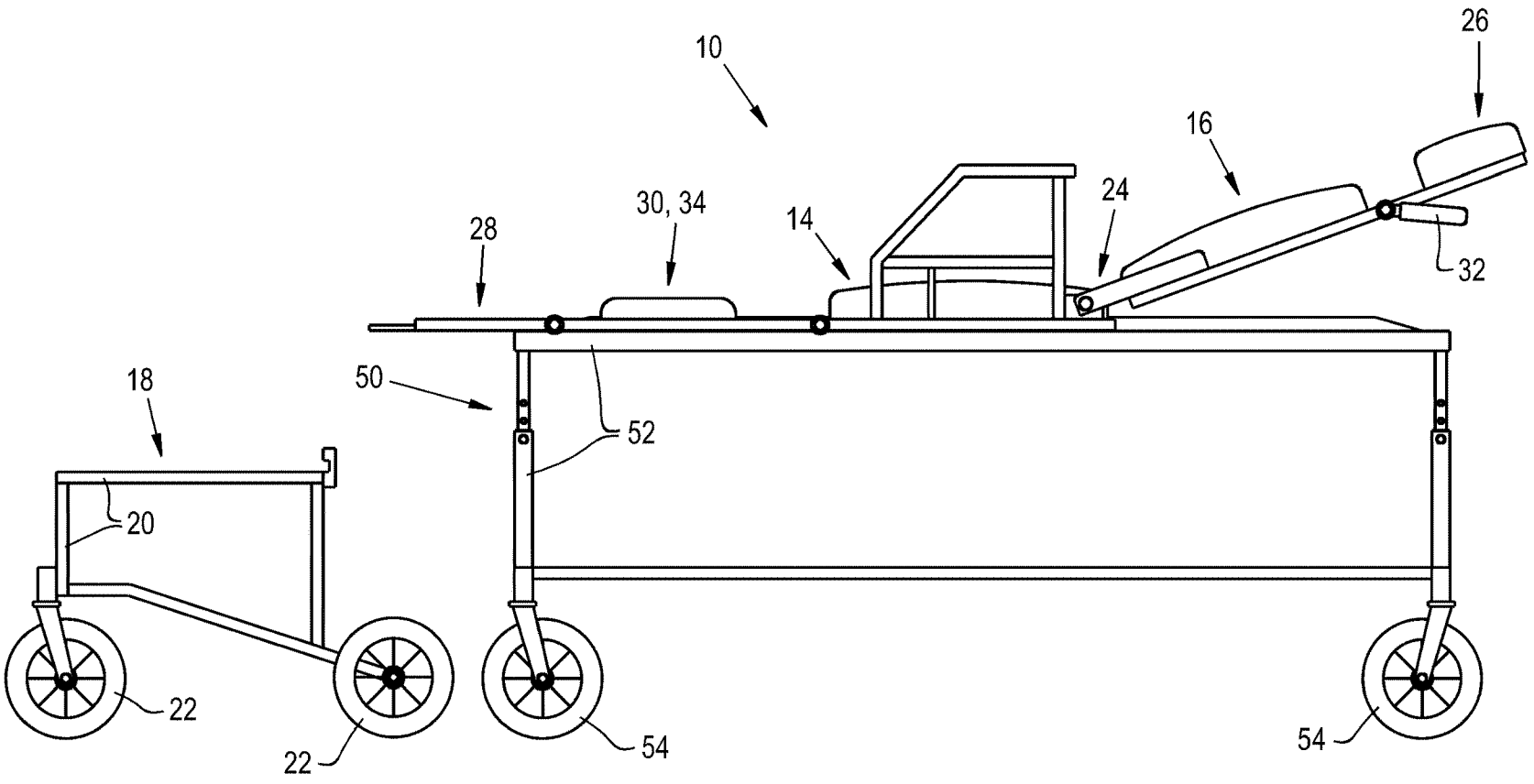
FIG. 1E illustrates the wheelchair of FIG. 1A as the wheelchair takes still yet another step in the transition to a horizontal transport position.
Figure 2:
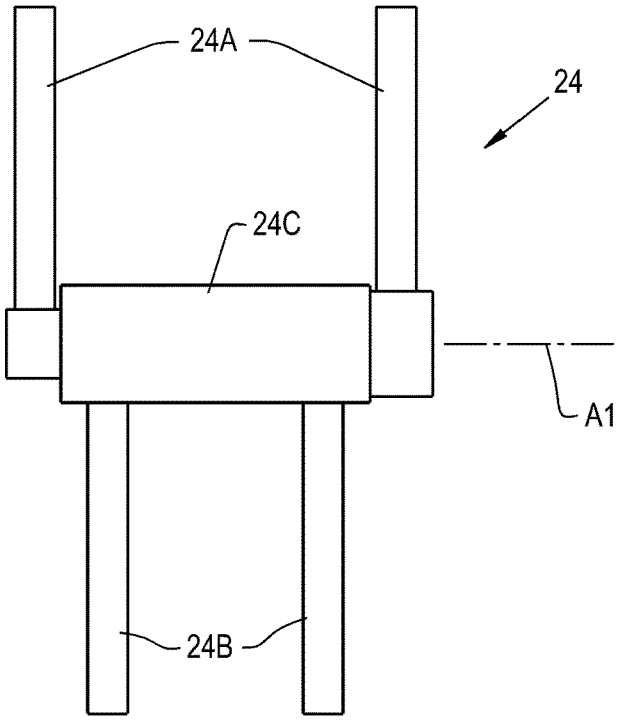
FIG. 2 is a closer look at a pivoting mechanism used on the wheelchair/transport system of FIGS. 1A-1E.
Figure 3:
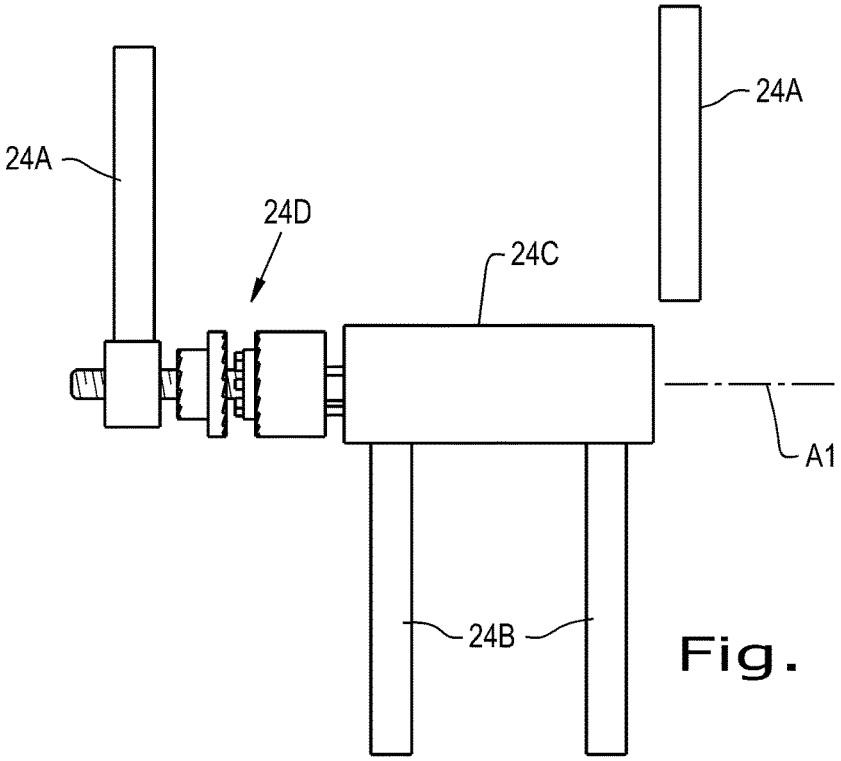
FIG. 3 is another view of the pivoting mechanism of FIG. 2 used on the wheelchair/transport system of FIGS. 1A-1E.
Figure 4:
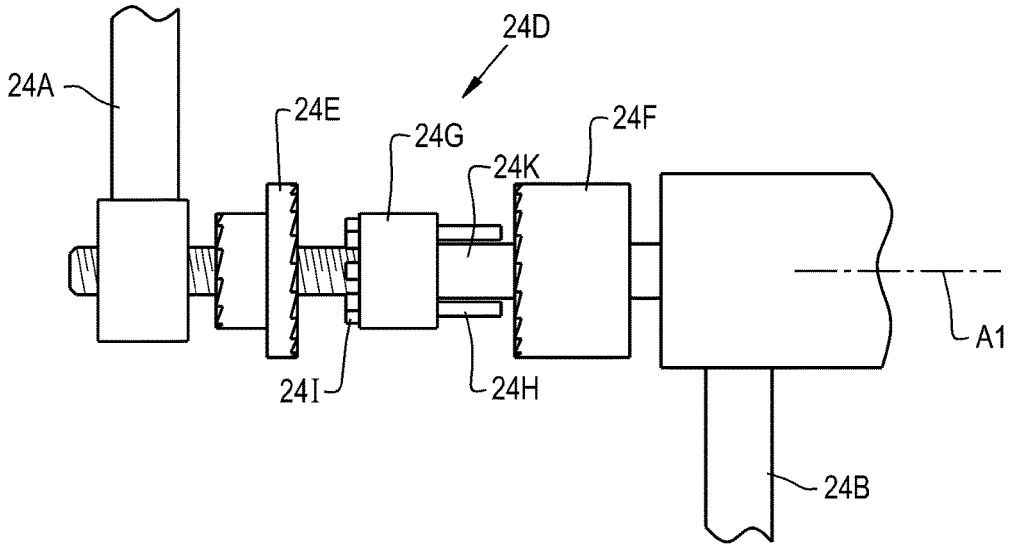
FIG. 4 is yet another view of the pivoting mechanism of FIGS. 2 and 3 used on the wheelchair/transport system of FIGS. 1A-1E.
Figure 5:
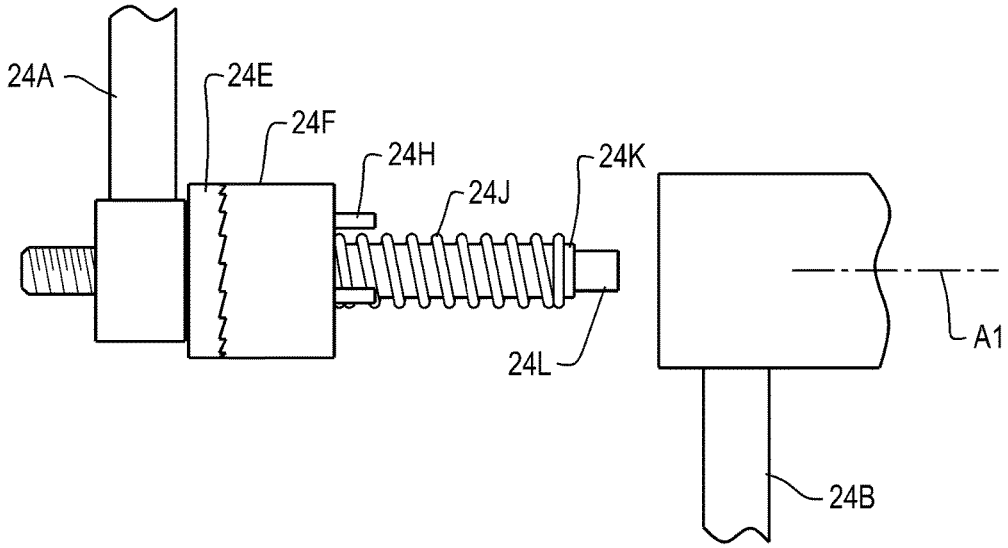
FIG. 5 is still yet another view of the pivoting mechanism of FIGS. 2-4 used on the wheelchair/transport system of FIGS. 1A-1E.
Figure 6:
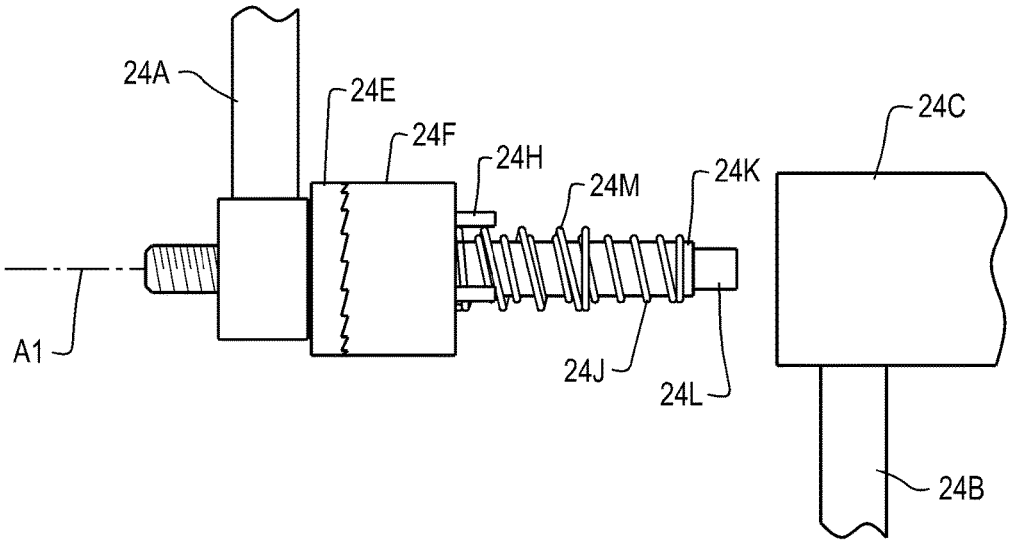
FIG. 6 is still yet another view of the pivoting mechanism of FIGS. 2-5 used on the wheelchair/transport system of FIGS. 1A-1E.

In a reverse order, when back support portion 16 is being raised, as shown in FIG. 1E, handle 32 is twisted to place pivoting mechanism in state 104, so that the raising of back support portion 16 takes place in a ratcheting mode. As back support portion 16 is moved pivoting mechanism 24 is not in locked state 106, which would prevent a pivoting movement.

Now looking at FIGS. 2-6 there are shown additional details of pivoting mechanism 24. Pivoting mechanism 24 includes back arms 24A, seat arms 24B and housing 24C. Back arms 24A are coupled to back support portion 16 and seat arms 24B are coupled to seat portion 14. Within housing 24C is ratcheting mechanism 24D that has toothed sections 24E and 24F. A locking device 24G has pins 24I and pins 24H extending therefrom. A sleeve 24K is coupled to locking device 24G. Toothed section 24F is cupped on the inside so that locking device 24G is contained therein. Pins 24H are slidingly coupled to holes in toothed section 24F and sleeve 24K is coupled to locking device 24G, so that the movement of sleeve 24K on shaft 24L when moved to the left causes pins 24I to engage holes in toothed section 24E, which places pivoting mechanism 24 into locked state 106 so that arms 24A and 24B are locked thereby preventing pivotal movement about axis A1.

A spring 24J biases locking device 24G toward locking state 106. A spring 24M biases toothed section 24F toward toothed section 24E. When handle 32 is positioned to place pivoting mechanism 24 in locking state 106 then device 24G and section 24 are completely engaged to the leftmost positions. As handle 32 is twisted pivoting mechanism 24 transitions to ratcheting state 104 by the movement of sleeve 24K, and hence locking device 24G to the right causing pins 24I to disengage from toothed section 24E, while leaving spring 24M causing sections 24E and 24F to remain engaged. Due to the angled tooth sequence of sections 24E and 24F arms 24A and 24B can ratchet about axis A1. When handle 32 is twisted further, causing pivoting mechanism 24 to transition to pivoting state 102 sleeve 24K is moved further to the right causing locking device 24G to bottom against an inside surface section 24F causing section 24F to disengage from section 24E.

A reverse movement of handle 32 causes pivoting mechanism 24 to transition to ratcheting state 104 then to locked state 106, as can be understood from the previous discussion.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A convertible transport system, comprising:

a seat portion;

a back support portion;

a pivoting mechanism coupled to the seat portion and to the back support portion, the pivoting mechanism being configured to adjust and lock the back support portion relative to the seat portion, the pivoting mechanism having three operative states:

a free pivoting state allowing the back support portion to pivot relative to the seat portion about an axis;

a ratcheting state allowing the back support portion to only pivot toward the seat portion about the axis; and a locking state in which the pivoting mechanism is locked to thereby prevent a pivoting movement of the back support portion relative to the seat portion; and a foot support portion; and a connecting member coupled to the foot support portion and to the seat portion, the connecting member being pivotally coupled to the foot support portion, the connecting member being pivotally coupled to the seat portion, the connecting member including a mechanism that couples an angular movement of the foot portion relative to the connecting member to an angular movement of the connecting member relative to the seat portion.

2. The convertible transport system of claim 1, further comprising a wheeled portion couplable to the seat portion.

3. The convertible transport system of claim 2, further comprising a support couplable to the seat portion and not to the wheeled portion.

4. The convertible transport system of claim 1, wherein the mechanism of the connecting member causes a clockwise movement of the connecting member relative to the seat portion to result in a counter-clockwise movement of the foot support portion.

5. The convertible transport system of claim 1, further comprising a control device controllingly coupled to the pivoting mechanism, the control device being movable by an operator to select the operative state of the pivoting mechanism.

6. A convertible transport system, comprising:

a seat portion;

a back support portion; and a pivoting mechanism coupled to the seat portion and to the back support portion, the pivoting mechanism being configured to adjust and lock the back support portion relative to the seat portion, the pivoting mechanism having three operative states:

a free pivoting state allowing the back support portion to pivot relative to the seat portion about an axis;

a ratcheting state allowing the back support portion to only pivot toward the seat portion about the axis;

a locking state in which the pivoting mechanism is locked to thereby prevent a pivoting movement of the back support portion relative to the seat portion; and a control device controllingly coupled to the pivoting mechanism, the control device being movable by an operator to select the operative state of the pivoting mechanism, the control device being connected to the back support portion.

7. The convertible transport system of claim 6, wherein the control device is connected at an end of the back support portion opposite of the pivoting mechanism.

8. The convertible transport system of claim 7, wherein the control device is also a handle that is used to manipulate the convertible transport system.

9. The convertible transport system of claim 8, wherein the handle is twistable to select the operative state of the pivoting mechanism.

10. The convertible transport system of claim 1, wherein when the pivoting mechanism has transitioned to a locking state the ratcheting state remains engaged, but immobilized.

11. A convertible wheelchair system, comprising:

a seat portion;

a wheeled portion decouplable from the seat portion;

a back support portion;

a pivoting mechanism coupled to the seat portion and to the back support portion, the pivoting mechanism being configured to adjust and lock the back support portion relative to the seat portion;

a foot support portion; and a connecting member coupled to the foot support portion and to the seat portion, the connecting member being pivotally coupled to the foot support portion, the connecting member being pivotally coupled to the seat portion, the connecting member including a mechanism that couples an angular movement of the foot portion relative to the connecting member to an angular movement of the connecting member relative to the seat portion.

12. The convertible wheelchair system of claim 11, further comprising a support couplable to the seat portion and not to the wheeled portion.

13. The convertible wheelchair system of claim 11, wherein the mechanism of the connecting member causes a clockwise movement of the connecting member relative to the seat portion to result in a counter-clockwise movement of the foot support portion.

14. The convertible wheelchair system of claim 11, further comprising a control device controllingly coupled to the pivoting mechanism, the control device being movable by an operator to select an operative state of the pivoting mechanism.

15. A convertible wheelchair system, comprising:

a seat portion;

a wheeled portion decouplable from the seat portion;

a back support portion;

a pivoting mechanism coupled to the seat portion and to the back support portion, the pivoting mechanism being configured to adjust and lock the back support portion relative to the seat portion, the pivoting mechanism having three operative states:

a free pivoting state allowing the back support portion to pivot relative to the seat portion about an axis;

a ratcheting state allowing the back support portion to only pivot toward the seat portion about the axis; and a locking state in which the pivoting mechanism is locked to thereby prevent a pivoting movement of the back support portion relative to the seat portion; and a control device controllingly coupled to the pivoting mechanism, the control device being movable by an operator to select the operative state of the pivoting mechanism, the control device being connected to the back support portion.

16. The convertible wheelchair system of claim 15, wherein the control device is connected at an end of the back support portion opposite of the pivoting mechanism.

17. The convertible wheelchair system of claim 16, wherein the control device is also a handle that is used to manipulate the convertible wheelchair system, the handle being twistable to select the operative state of the pivoting mechanism.

18. The convertible wheelchair system of claim 15, wherein when the pivoting mechanism transitions to a locking state the ratcheting state remains engaged, but immobilized.

* * * * *